US007686600B2

(12) United States Patent
Ohmi

(10) Patent No.: US 7,686,600 B2
(45) Date of Patent: Mar. 30, 2010

(54) VACCUM PUMP HAVING SHAFT SEAL TO PREVENT CORROSION AND TO ENSURE SMOOTH OPERATION

(75) Inventor: Tadahiro Ohmi, Miyagi (JP)

(73) Assignee: Foundation for Advancement of International Science, Tsukuba-shi (JP)

( * ) Notice: Subject to any disclaimer, the term of this patent is extended or adjusted under 35 U.S.C. 154(b) by 597 days.

(21) Appl. No.: 10/591,430

(22) PCT Filed: Feb. 14, 2005

(86) PCT No.: PCT/JP2005/002153

§ 371 (c)(1),
(2), (4) Date: Sep. 1, 2006

(87) PCT Pub. No.: WO2005/085643

PCT Pub. Date: Sep. 15, 2005

(65) Prior Publication Data

US 2007/0172376 A1 Jul. 26, 2007

(30) Foreign Application Priority Data

Mar. 2, 2004 (JP) ..... 2004-057041

(51) Int. Cl.
*F01C 19/00* (2006.01)
*F03C 2/00* (2006.01)

(52) U.S. Cl. ..... 418/104; 418/178; 418/179; 418/201.1; 277/411; 277/418; 277/935; 277/936

(58) Field of Classification Search ..... 418/104, 418/201.1, 178, 179, 149; 277/409, 411, 277/412, 417, 418, 423, 432, 927, 935, 936
See application file for complete search history.

(56) References Cited

U.S. PATENT DOCUMENTS

| | | | | |
|---|---|---|---|---|
| 3,071,384 | A | | 1/1963 | Friberg |
| 5,525,047 | A | * | 6/1996 | Sternenberg et al. ..... 277/636 |
| 5,924,855 | A | | 7/1999 | Dahmlos et al. |
| 6,200,116 | B1 | * | 3/2001 | Schofield et al. ..... 418/194 |
| 6,217,306 | B1 | | 4/2001 | Schofield et al. |
| 2006/0188383 | A1 | * | 8/2006 | Ohmi ..... 418/201.1 |

FOREIGN PATENT DOCUMENTS

| | | | |
|---|---|---|---|
| JP | 61-043298 | | 3/1986 |
| JP | 63285279 A | * | 11/1988 |
| JP | 1-216082 | | 8/1989 |
| JP | 2000-073976 A | | 3/2000 |
| JP | 2001056027 A | * | 2/2001 |
| WO | WO 97/01038 | | 1/1997 |

OTHER PUBLICATIONS

"Physics Dictionary" compiled by Physics Dictionary Editorial Board, Baifukan, Revised Edition published May 20, 1992, p. 1019.

* cited by examiner

*Primary Examiner*—Theresa Trieu
(74) *Attorney, Agent, or Firm*—Foley & Lardner LLP

(57) ABSTRACT

Abstract A shaft seal structure (17) is provided around an outer circumferential surface of the bearing member (16M, 16FM) located on the cylinder inside of each of the screw rotors (13M, 13FM). The shaft seal structure (17) forms a static pressure seal. A seal gas is introduced between the outer circumferential surfaces of the bearing members (16M, 16FM) and the inner circumferential surfaces (7) of the rotor cylinders of the screw rotors (13M, 13FM) through the bearing members (16M, 16FM).

7 Claims, 4 Drawing Sheets

VACCUM PUMP HAVING SHAFT SEAL TO PREVENT CORROSION AND TO ENSURE SMOOTH OPERATION

TECHNICAL FIELD

This invention relates to a vacuum pump and, in particular, relates to a vacuum pump for use in the field of manufacturing semiconductor devices, flat panel display devices, or the like.

BACKGROUND ART

Vacuum pumps are used in the semiconductor manufacturing field, the manufacturing field of flat panel display devices and so on, and many other industrial fields that require depressurization. As the vacuum pump, use is made of, for example, a screw pump. The screw pump is disclosed, for example, in Non-Patent Document 1 as a screw type pump.

Generally, the screw pump comprises a pair of screw rotors having a first screw rotor with a plurality of helical land portions and a plurality of helical groove portions (a male rotor with convex thread ridges) and a second screw rotor with a plurality of helical land portions and a plurality of helical groove portions (a female rotor with concave thread grooves) and adapted to rotate about two axes substantially parallel to each other while meshing with each other, and a casing receiving therein the pair of screw rotors and having an inlet port and a discharge port. Further, a pair of shafts supporting the pair of screw rotors are provided with a pair of bearings and a pair of shaft seal members.

In the conventional pump, ball bearings are generally used as the bearings. Therefore, seal mechanisms such as oil seals or mechanical seals are added between the screws and the ball bearings and further a large amount of gas is introduced to the seal portions. However, since it is not possible to completely prevent leakage of ball bearing oil to the screw (pump) side, in case of being used as a vacuum pump in a processing step (plasma etching, reduced-pressure vapor phase epitaxy) that emits a toxic gas, a corrosive gas, or the like in a depressurized state when, for example, manufacturing semiconductor elements, the gas contacts the ball bearings to corrode the bearings or the oil at the bearing portions flows into the inside of the pump, thereby causing serious failure in the processing step. Further, there has been a technical problem that reaction product is accumulated on the ball bearings to impede smooth operation.

Further, there has been a big technical problem that since the gas introducing amount is large, a huge cost is required for separating and recovering an expensive gas such as Kr or Xe used in the processing step.

Non-Patent Document 1: "Physics Dictionary" compiled by Physics Dictionary Editorial Board, Baifukan, Revised Edition published May 20, 1992, p. 1019

DISCLOSURE OF THE INVENTION

Problem to be Solved by the Invention

This invention has been made for solving the foregoing problems and has an object to provide a vacuum pump having shaft seals that prevent corrosion due to corrosive gas and further ensure smooth operation.

Means for Solving the Problem

Vacuum pumps according to this invention are as follows.

(1) A vacuum pump comprising a pair of screw rotors each having a substantially hollow-cylindrical shape with one end closed, each having a plurality of helical land portions and a plurality of helical groove portions, and adapted to rotate about substantially parallel two axes while meshing with each other, a casing receiving therein the pair of screw rotors, a pair of shafts provided so as to extend from the closed ends on the cylinder inside of the pair of screw rotors, respectively, and supporting the pair of screw rotors, respectively, and a pair of bearing members each having a substantially hollow-cylindrical shape and disposed between inner circumferential surfaces of rotor cylinders of the pair of screw rotors and outer circumferential surfaces of the pair of shafts, respectively, the pair of bearing members having bearings at inner circumferential surfaces thereof, respectively. A shaft seal structure is provided around an outer circumferential surface of the bearing member located on the cylinder inside of each of the screw rotors. The shaft seal structure forms a static pressure seal, and a seal gas is introduced between the outer circumferential surfaces of the bearing members and the inner circumferential surfaces of the rotor cylinders of the screw rotors through the bearing members.

(2) The vacuum pump as recited in the foregoing item (1), wherein the screw rotors are each centered with respect to the bearing member by the introduced seal gas.

(3) The vacuum pump as recited in the foregoing item (1) or (2), wherein the shaft seal structure comprises a substantially hollow-cylindrical shaft seal member installed in a concave portion circumferentially formed on the outer circumferential surface of the bearing member and the shaft seal member is not in contact with the inner circumferential surface of the rotor cylinder during the stationary operation.

(4) The vacuum pump as recited in the foregoing item (3), wherein the shaft seal member includes a porous member and the seal gas is introduced between the outer circumferential surface of the bearing member and the inner circumferential surface of the rotor cylinder of the screw rotor through the shaft seal member from the bearing member.

(5) The vacuum pump as recited in the foregoing item (4), wherein the porous member has a porosity of 1% to 20% and a gas introduction pressure to the porous member is 2 MPa to 100 MPa.

(6) The vacuum pump as recited in the foregoing item (3), wherein the shaft seal member has a seal gas passing port opened in a radial direction and the seal gas is introduced between the outer circumferential surface of the bearing member and the inner circumferential surface of the rotor cylinder of the screw rotor through the shaft seal member from the bearing member.

(7) The vacuum pump as recited in the foregoing item (6), wherein the seal gas passing port is provided at a position in a cylinder axis direction of the bearing member where back diffusion of the seal gas does not occur either to the screw rotor side or to the bearing side.

(8) The vacuum pump as recited in any one of the foregoing items (3) to (7), wherein said shaft seal member comprises a plurality of substantially hollow-cylindrical shaft seal member pieces that are juxtaposed in said concave portion while partly overlapping each other in the cylinder axis direction of said bearing member and urging means is disposed between said shaft seal member pieces for urging said shaft seal member pieces in said cylinder axis direction in said concave portion.

(9) The vacuum pump as recited in any one of the foregoing items (3) to (7), wherein the shaft seal member is formed by a single substantially hollow-cylindrical component and an O-ring is disposed at an end surface of the shaft seal member for urging the shaft seal member in the cylinder axis direction in the concave portion.

(10) The vacuum pump as recited in any one of the foregoing items (3), (6), and (7), wherein the shaft seal member is integrally formed with the bearing member.

(11) The vacuum pump as recited in any one of the foregoing items (1) to (10), wherein a gap between the outer circumferential surface of the bearing member and the inner circumferential surface of the rotor cylinder of the screw rotor is formed in a tapered shape so as to expand as approaching an exhaust side of an exhaust gas of the vacuum pump.

(12) The vacuum pump as recited in any one of the foregoing items (1) to (11), wherein the seal gas is set to such flow velocity where there occurs no back diffusion of the exhaust gas from the exhaust side of the vacuum pump.

(13) The vacuum pump as recited in any one of the foregoing items (1) to (11), wherein the seal gas is set to such flow velocity where there occurs no back diffusion of the exhaust gas from the exhaust side of the vacuum pump, and to prevent oil from flowing into the pump side from the bearing side.

(14) The vacuum pump as recited in any one of the foregoing items (1) to (11), wherein the seal gas is set to such flow velocity where there occur no back diffusion of the exhaust gas to the bearing side from the exhaust side of the vacuum pump and no back diffusion of oil to the pump side from the bearing side.

Effect of the Invention

According to this invention, it is possible to obtain a vacuum pump comprising shaft seals that largely reduce the consumption amount of seal gas, prevent corrosion due to corrosive gas, facilitate gas recovery, and further ensure smooth operation.

Further, according to this invention, the smooth operation of a screw pump is enabled and, when the operation is smoothed, the rotation can be faster. When the rotation becomes faster, the pumping speed increases so that the ultimate pressure can be reduced. As a result, the uniform pumping speed can be maintained even over the low inlet pressure region and, hence, in the case of a system formed by connecting vacuum pumps in a plurality of stages, it is possible to omit the pump such as, for example, a turbomolecular pump at the stage prior to the present vacuum pump.

Figure 1:
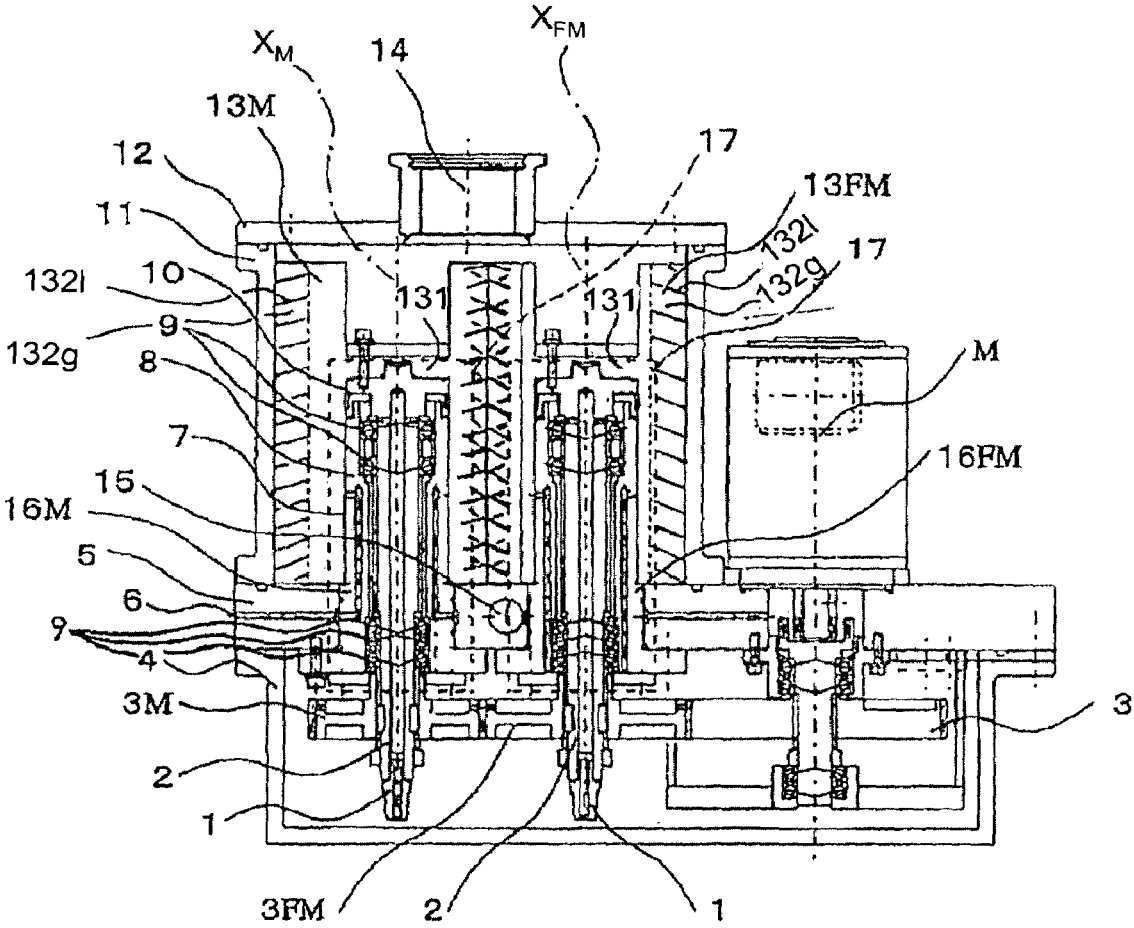
[FIG. 1] A sectional view showing a screw pump according to an embodiment of this invention.

1 oil supply nozzle
2 shaft
3 drive gear
3M male timing gear
3FM female timing gear
4 gearbox
5 exhaust plate
6 seal gas supply port
7 inner circumferential surface
8 shaft seal member
8*a*, 8*b* shaft seal member piece
9 bearing
10 bearing presser nut
11 casing
12 suction plate
13M, 13FM screw rotor
131 closed end portion
132*g* helical groove portion
1321 helical land portion
14 inlet port
15 discharge port
16M, 16FM bearing member
17 shaft seal structure
18 plate spring
19 0-ring
20 shaft seal space portion
21 seal gas passing port
$X_m$, $X_{FM}$ axis
X seal gas passing port

BEST MODE FOR CARRYING OUT THE INVENTION

Hereinbelow, a vacuum pump according to this invention will be described on the basis of an embodiment shown in the figures. This embodiment will be described using a screw pump of FIG. 1 as an example.

Embodiment 1

A screw pump body A comprises a pair of screw rotors 13M and 13FM each having a substantially hollow-cylindrical shape with one site closed (a closed portion 131).

The screw rotor 13M is a first screw rotor having a plurality of helical land portions 1321 and a plurality of helical groove portions 132*g*. The screw rotor l3FM is a second screw rotor having a plurality of helical land portions 1321 and a plurality of helical groove portions 132*g*. These screw rotors 13M and 13FM rotate about two axes $X_M$ and $X_{FM}$ substantially parallel to each other while meshing with each other. In FIGS. referred to by the specification, the helical land portions 1321 and the helical groove portions 132*g* are schematically shown.

The screw rotors 13M and 13FM are received in a casing 11 and rotatably supported by a plurality of bearings 9 provided in substantially hollow-cylindrical bearing members 16 (bearing members 16M and 16FM) through shafts 2 supporting the screw rotors 13M and 13FM, respectively. The shafts 2 are attached to inside surfaces of the closed portions 131 of the screw rotors 13M and 13FM, respectively. Timing gears 3M and 3FM are attached to the shafts 2 at one-end portions closed end portions 131 thereof, respectively, so that the pair of screw rotors 13M and 13FM are synchronously rotated through the timing gears 3M and 3FM.

An inlet port 14 is formed in a suction plate 12 at an opposite-side end portion of the casing 11 receiving therein the pair of screw rotors 13M and 13FM while a discharge port 15 is formed in an exhaust plate 5 on the other end side of the casing 11. When the screw rotors 13M and 13FM synchronously rotate, a gas is sucked through the inlet port 14 and exhausted through the discharge port 15 so that the operation of the vacuum pump is carried out.

Although not illustrated, the exhaust plate is provided with a cooling mechanism for, particularly, cooling heat of the gas caused by the compression operation on the discharge port 15 side.

A cover 4 is attached to the exhaust plate 5 attached at the one-end portion of the casing 11 having the screw rotors 13M and 13FM received therein. The timing gear 3FM of the shaft 2 supporting the screw rotor 13FM is directly connected by a drive gear 3 installed on a rotation shaft of a motor M attached to the exhaust plate 5.

Further, a shaft seal structure 17 is provided between the bearing member 16M and the screw rotor 3M, and a shaft seal structure 17 is also provided between the bearing member 16FM and the screw rotor 3FM.

Now, referring also to FIG. 2 in addition to FIG. 1, description will be given in detail of a configuration of the shaft seal structure 17 with a centering mechanism. The shaft seal structure 17 forms a static pressure seal and an inert gas such as, for example, a nitrogen gas is introduced into a shaft seal space portion 20 from a seal gas introduction port 6 through the inside of each of the bearing members 16M and 16FM and the outer circumferential surface of each of the bearing members 16M and 16FM under a predetermined pressure. The concave portion 20 is circumferentially formed on the outer circumferential surface of each of the bearing members 16M and 16FM. In the concave portion 20 is disposed a substantially hollow-cylindrical shaft seal member 8 in the form of a porous member made of carbon or the like. The shaft seal member 8 includes two substantially hollow-cylindrical shaft seal member pieces 8*a* and 8*b*. The two shaft seal member pieces 8*a* and 8*b* are juxtaposed in the cylinder axis direction of the bearing member 16M, 16PM while partly overlapping each other. In order to dispose the two shaft seal member pieces 8*a* and 8*b* with no clearances in the concave portion 20, a plate spring 18 is provided between the two shaft seal member pieces 8*a* and 8*b* for urging the shaft seal member pieces 8*a* and 8*b* in extending directions of the shaft 2.

The flow velocity of the seal gas that flows in the shaft seal structure is determined by the size of a gap where the seal gas flows and the flow rate and it is preferable that the flow velocity be selected so as to prevent back diffusion from the exhaust side. It is preferable that the porosity of the porous members, i.e. the shaft seal member pieces 8*a* and 8*b*, be set to 1% to 20% and the seal gas pressure be set to 2 MPa to 100 MPa. Further, the pressure of the inert gas such as the nitrogen gas that flows at a gap portion between the inner circumferential surface 7 of the rotor cylinder and the shaft seal member piece 8*a* or 8*b* from a seal gas discharge port in the concave portion 20 is preferably set to 0.01 MPa to 5 MPa.

The shaft seal member pieces 8*a* and 8*b* are formed by the porous members as described above and, further, the seal gas being the high-pressure inert gas permeates the shaft seal member pieces 8*a* and 8*b* and flows to the bearing 9 side while a portion thereof also flows to the screw rotor side (pump side) being the depressurizing side. As a result, a corrosive gas or the like does not contact the bearings 9, thereby preventing troubles such as corrosion of the bearings 9 and accumulation of reaction product on the bearings to impede smooth operation.

Further, since the screw rotor 13M, 13FM is centered with respect to the bearing member 16M, 16FM by the flow of the seal gas from the shaft seal member pieces 8*a* and 8*b* so that vibration of the screw rotor 13M, 13FM is suppressed, the gap between the outer circumferential surface of the shaft seal member pieces 8*a* and 8*b* and the inner circumferential surface 7 of the rotor cylinder can be narrowed. Consequently, the consumption amount of the seal gas can be reduced.

Now, modifications will be described with reference to FIGS. 3 and 4.

Figure 2:
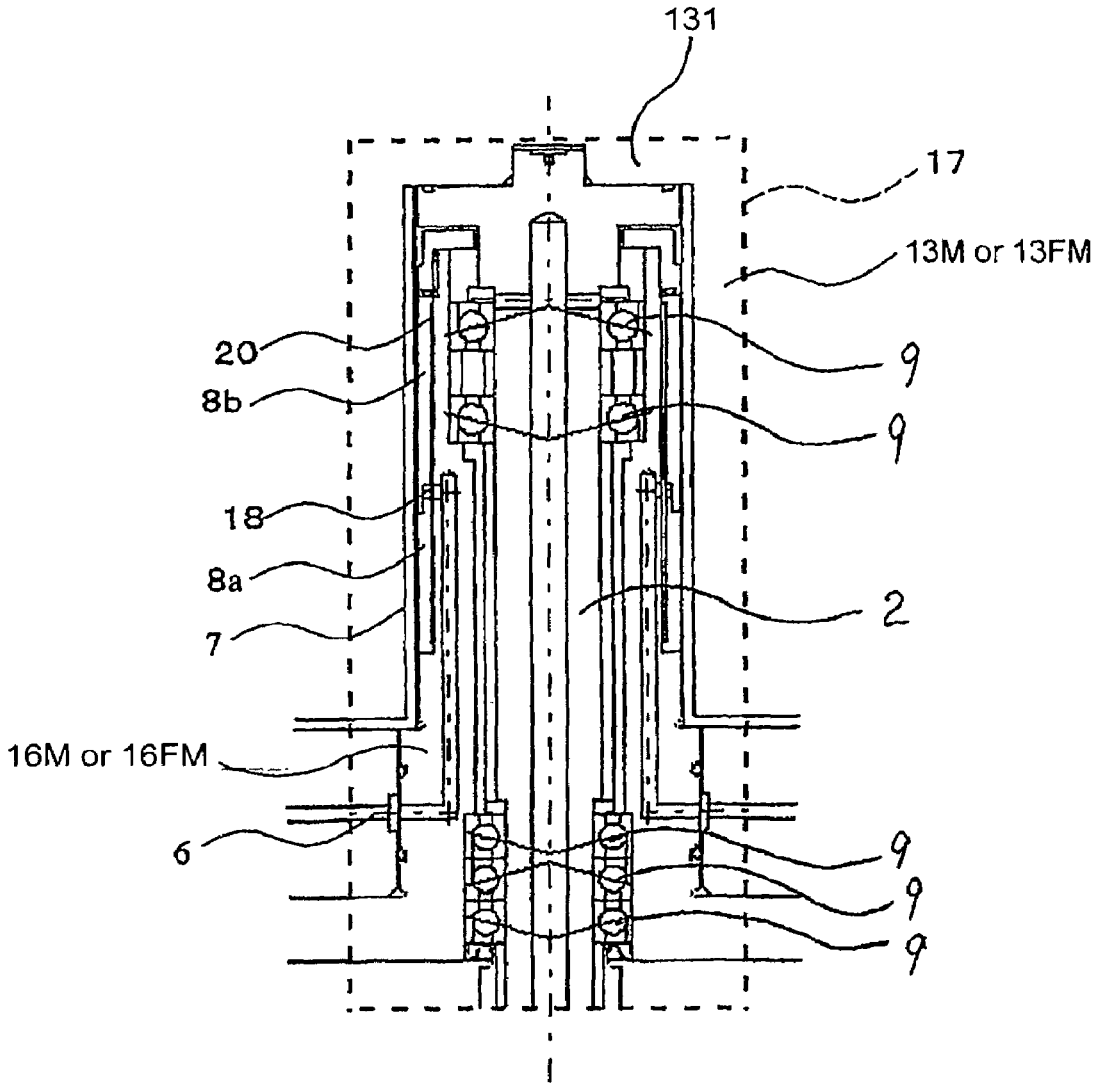
[FIG. 2] A sectional view showing in detail a shaft seal structure in FIG. 1.
Figure 3:
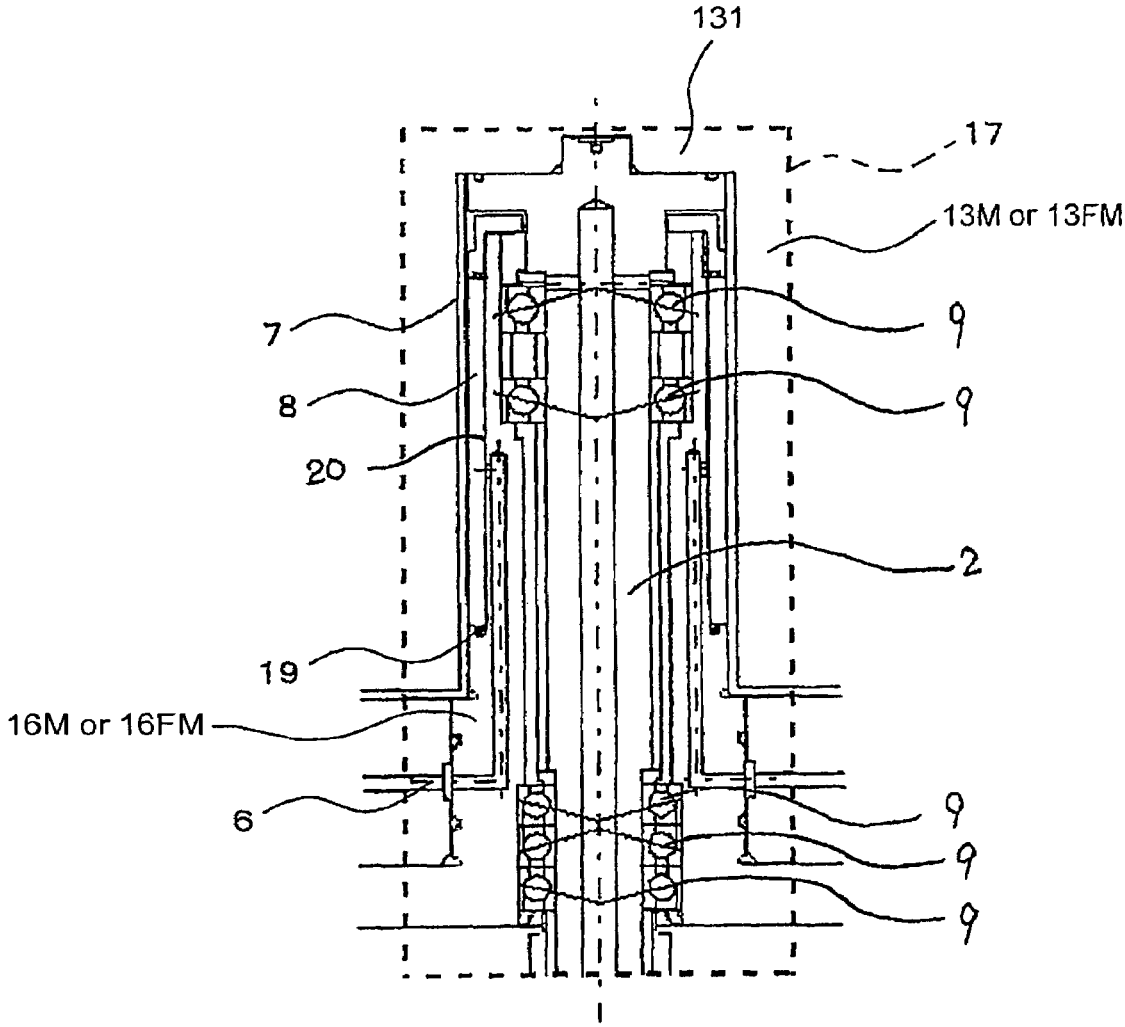
[FIG. 3] A sectional view showing a modification of a shaft seal member in FIG. 2.

Referring to FIG. 3, in this example, as opposed to the example shown in FIG. 2, a shaft seal member is a single shaft seal member 8 in the form of a porous member having a substantially hollow-cylindrical shape and gas leakage from a side is prevented by the use of an O-ring 19. Also in this example, since the screw rotor 13M, 13FM is centered with respect to the shaft seal member 8 by the seal gas having permeated the shaft seal member 8 so that vibration of the screw rotor is suppressed, a gap between the screw rotor 13M, 13FM and the shaft seal member 8 can be narrowed. Consequently, the consumption amount of the seal gas can be reduced.

Figure 4:
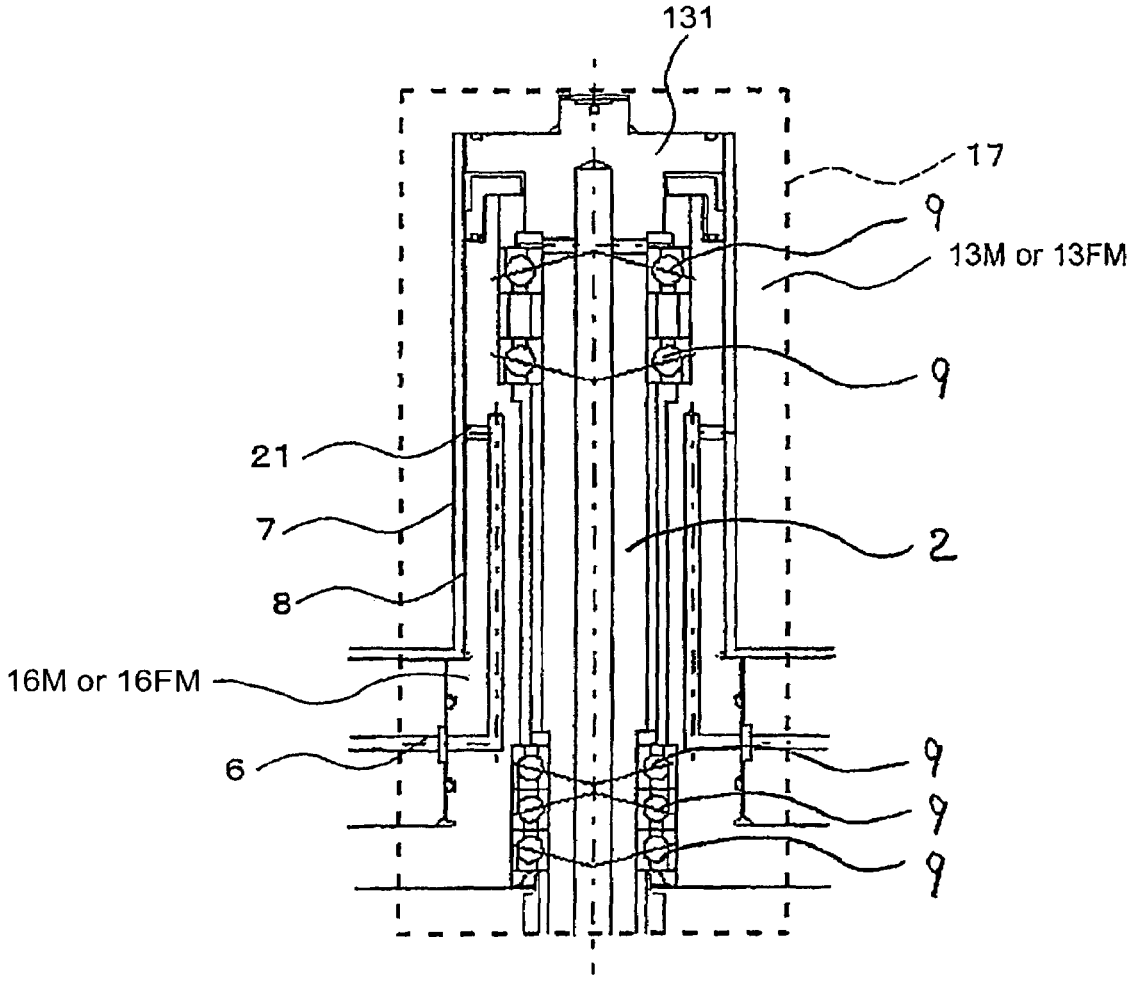
[FIG. 4] A sectional view showing another modification of the shaft seal member in FIG. 2.

Referring to FIG. 4, in this example, a substantially hollow-cylindrical shaft seal member 8 is integral with a bearing member 16M, 16FM and is not a porous member. In the case of the shaft seal member 8 being not the porous member as described above, the shaft seal member 8 is provided with a seal gas passing port 21. The seal gas passing port 21 is provided at a position of a ratio where back diffusion does not occur either to the screw rotor side (pump side) or to the bearing 9 side.

In this invention, it is also possible to form a shaft seal member that is not a porous member but is separate from the bearing member 16M, 16FM.

Further, although not illustrated in FIG. 4, a gap between the outer circumferential surface of the bearing member including the outer circumferential surface of the shaft seal member 8 and the r inner circumferential surface 7 of the rotor cylinder is formed club-shaped toward the discharge port side, i.e. so-called tapered. That is, the outer circumferential surface of the shaft seal member 8, the inner circumferential surface 7, or both the outer circumferential surface of the shaft seal member 8 and the inner circumferential surface 7 are formed in a tapered shape.

By, as described above, forming the outer circumferential surface of the shaft seal member 8, the inner circumferential surface 7, or both the outer circumferential surface of the shaft seal member 8 and the inner circumferential surface 7 to be tapered to thereby taper a shaft seal space portion 20 so as to be club-shaped toward the discharge port side, even if the shaft 2 is subjected to runout with respect to the bearings 9, there is no occurrence of contact between the screw rotor 13M, 13FM and the shaft seal member 8 so that it is possible to maintain the seal function and achieve smooth rotation.

According to this invention, the smooth operation of the screw pump is enabled by the shaft seal structure serving as the static pressure seal and, when the operation is smoothed, the rotation can be faster. When the rotation becomes faster, the pumping speed increases so that the ultimate pressure can be reduced. As a result, the uniform pumping speed can be maintained even over the low inlet pressure region and, hence, in the case of a system formed by connecting vacuum pumps in a plurality of stages, it is possible to omit the pump such as, for example, a turbomolecular pump at the stage prior to the present vacuum pump.

INDUSTRIAL APPLICABILITY

In the foregoing embodiment, the description has been made of the semiconductor device manufacturing vacuum system. However, the use of the vacuum system of this invention is not limited to a semiconductor device manufacturing apparatus but it can be used in every industrial field that requires depressurization, such as the flat panel display device manufacturing field.

The invention claimed is:

1. A vacuum pump comprising:

a pair of screw rotors each having a substantially hollow-cylindrical shape with one site closed and rotating about substantially parallel two axes, respectively;

a pair of shafts attached to inside surfaces of the closed portions of said screw rotors so as to extend along said axes, respectively;

a pair of bearing members each having a substantially hollow-cylindrical shape and disposed between inner circumferential surfaces of said screw rotors and outer circumferential surfaces of said shafts, respectively, said bearing members having bearings at inner circumferential surfaces thereof, respectively, said bearing members supporting said screw rotors with permitting rotations of said screw rotors about said axes, respectively; and a shaft seal structure structured between the outer circumferential surfaces of said bearing members and the inner circumferential surfaces of said screw rotors;

wherein said shaft seal structure comprises a substantially hollow-cylindrical shaft seal members circumferentially attached to said other circumferential surfaces of said bearing members, each of said shaft seal members being porous; and wherein a seal gas is introduced to gaps between said outer circumferential surfaces of said bearing members and inner circumferential surfaces of said screw rotors from overall of outer circumferential surfaces of said shaft seal member, respectively;

thereby said shaft seal structure forms a static pressure seal so that said screw rotors are centered with respect to said axes without runout and a contact of said inner circumferential surfaces thereof with said shaft seal members, respectively.

2. A vacuum pump according to claim 1, wherein each of said shaft seal members has a porosity of 1% to 20%, and a gas introduction pressure to said shaft seal members is 2 MPa to 100 MPa.

3. A vacuum pump according to claim 1, wherein said shaft seal members comprise a plurality of substantially hollow-cylindrical shaft seal member pieces that are juxtaposed while partly overlapping with one another along said axes, respectively.

4. A vacuum pump according to claim 1, wherein an O-ring is disposed at an end surface of each of said shaft seal members.

5. A vacuum pump according to claim 1, wherein said shaft seal members are integrally formed with said bearing members, respectively.

6. A vacuum pump according to claim 1 wherein said gaps between said outer circumferential surfaces of said bearing members and said inner circumferential surfaces of said screw rotors are formed in a tapered shape so as to expand as approaching an exhaust side of an exhaust gas of said vacuum pump, respectively.

7. A vacuum pump according to claim 1, wherein the seal gas is set to such flow velocity that prevents occurrence of back diffusion of the exhaust gas from an exhaust side of said vacuum pump and further prevents oil from flowing into the pump side from a bearing side.

* * * * *